US008654032B2

(12) United States Patent
Yoon et al.

(10) Patent No.: US 8,654,032 B2
(45) Date of Patent: Feb. 18, 2014

(54) APPARATUS FOR MULTIPLE ANTENNAS IN WIRELESS COMMUNICATION SYSTEM

(75) Inventors: Byung-Tae Yoon, Suwon-si (KR); Jong-Wook Zeong, Seoul (KR); Jae-Hoon Jo, Seoul (KR); Mi-Hyun Son, Seoul (KR); Se-Hyun Park, Suwon-si (KR); Hee-Jun Lee, Ansan-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 461 days.

(21) Appl. No.: 13/008,149

(22) Filed: Jan. 18, 2011

(65) Prior Publication Data

US 2011/0175792 A1 Jul. 21, 2011

(30) Foreign Application Priority Data

Jan. 21, 2010 (KR) ..... 10-2010-0005453

(51) Int. Cl.
*H01Q 21/10* (2006.01)
*H01Q 1/24* (2006.01)

(52) U.S. Cl.
USPC ..... 343/893; 343/810; 343/853; 343/702

(58) Field of Classification Search
None
See application file for complete search history.

(56) References Cited

U.S. PATENT DOCUMENTS

| | | | | |
|---|---|---|---|---|
| 7,557,761 | B2 * | 7/2009 | Iwai et al. | 343/702 |
| 8,164,525 | B2 * | 4/2012 | Park et al. | 343/702 |
| 2002/0024466 | A1 * | 2/2002 | Masuda | 343/700 MS |
| 2006/0279465 | A1 | 12/2006 | Moon et al. | |
| 2008/0150828 | A1 * | 6/2008 | An et al. | 343/848 |
| 2008/0174508 | A1 | 7/2008 | Iwai et al. | |
| 2008/0278405 | A1 | 11/2008 | Montgomery et al. | |
| 2009/0102742 | A1 | 4/2009 | Park et al. | |
| 2011/0175792 | A1 * | 7/2011 | Yoon et al. | 343/893 |
| 2013/0050052 | A1 * | 2/2013 | Park et al. | 343/876 |

FOREIGN PATENT DOCUMENTS

JP 2002-076735 A 3/2002

* cited by examiner

*Primary Examiner* — Trinh Dinh
(74) *Attorney, Agent, or Firm* — Jefferson IP Law, LLP

(57) ABSTRACT

An apparatus for multiple antennas having a low coupling coefficient in a wide frequency bandwidth in a wireless communication system is provided. To obtain the low coupling coefficient in the wide frequency bandwidth by minimizing interference between antennas which are close to each other, without an additional device, in the wireless communication system, the apparatus includes a transceiver and a line for decreasing a coupling coefficient. The transmitter includes a first antenna and a second antenna for transmitting and receiving signals over a radio channel and the line is indirectly connected the first antenna and the second antenna using a physically disconnected line.

8 Claims, 11 Drawing Sheets

APPARATUS FOR MULTIPLE ANTENNAS IN WIRELESS COMMUNICATION SYSTEM

PRIORITY

This application claims the benefit under 35 U.S.C. §119 (a) of a Korean patent application filed in the Korean Intellectual Property Office on Jan. 21, 2010 and assigned Serial No. 10-2010-0005453, the entire disclosure of which is hereby incorporated by reference.

BACKGROUND OF THE INVENTION

1. Field of the Invention

The present invention relates to multiple antennas in a wireless communication system. More particularly, the present invention relates to an apparatus for multiple antennas having a low coupling coefficient in a wide frequency bandwidth in a wireless communication system.

2. Description of the Related Art

An antenna used in a portable phone may be embodied as a whip antenna using a straight metal wire, a helical antenna winding a metal wire in the form of a helix, and a retractable antenna. In response to consumer demand for portable and small-size terminals, the antenna of the terminal is replaced with an embedded antenna. The embedded antenna employs an inverted-F antenna including a feed line at a certain position having a ' ' ' ' shaped metal element.

To apply Multiple Input Multiple Output (MIMO) technology, the terminal needs to include a plurality of antennas. To install two inverted-F antennas to the terminal, the two antennas can be situated as shown in FIG. 1.

FIG. 1 illustrates a layout of antennas in a wireless communication system according to the related art.

Referring to FIG. 1, an antenna #1 101 and an antenna #2 102 are placed at perpendicular sides around the same corner of a board. Signals are fed into the antennas 101 and 102 via feeders 111. The antennas 101 and 102 are connected to the ground through ground parts 112.

FIG. 2 illustrates characteristics of antennas in a wireless communication system according to the related art.

Referring to FIG. 2, a horizontal axis indicates a frequency band, and a vertical axis indicates a magnitude of a reflection coefficient and a coupling coefficient. Reflection coefficient (S12) is a parameter indicating the degree of antenna transmission power that is reflected, rather than emitted. Lower reflection coefficient (S11) signifies a better antenna radiation performance. Coupling coefficient (S21) is a parameter indicating the degree of the signal emitted from one antenna and input to another antenna. The lower coupling coefficient signifies a lower interference between the antennas.

The coupling of antennas 101 and 102 of FIG. 1 increases a coupling coefficient S21 as shown in FIG. 2. When the distance between the antennas is shortened to mount the plurality of the antennas within a narrow space, the coupling coefficient increases even further.

Therefore a need exists for an apparatus and a method for minimizing a coupling coefficient between multiple antennas in a wireless communication system.

SUMMARY OF THE INVENTION

An aspect of the present invention is to address at least the above-mentioned problems and/or disadvantages and to provide at least the advantages described below. Accordingly, an aspect of the present invention is to provide an apparatus for minimizing a coupling coefficient between multiple antennas in a wireless communication system.

Another aspect of the present invention is to provide an apparatus for lowering a coupling coefficient of an antenna within a maximum frequency range in a wireless communication system.

Yet another aspect of the present invention is to provide an apparatus for obtaining a low coupling coefficient in a wide frequency bandwidth by minimizing interference between antennas, which are close to each other, without an additional device, in a wireless communication system.

In accordance with an aspect of the present invention, a transceiver having a plurality of antennas in a wireless communication system is provided. The transceiver includes a first antenna and a second antenna for transmitting and receiving signals over a radio channel, and a line for decreasing a coupling coefficient by indirectly connecting the first antenna and the second antenna using a physically disconnected line.

Other aspects, advantages, and salient features of the invention will become apparent to those skilled in the art from the following detailed description, which, taken in conjunction with the annexed drawings, discloses exemplary embodiments of the invention.

BRIEF DESCRIPTION OF THE DRAWINGS

The above and other aspects, features, and advantages of certain exemplary embodiments of the present invention will be more apparent from the following description taken in conjunction with the accompanying drawings, in which.

Throughout the drawings, like reference numerals will be understood to refer to like parts, components and structures.

DETAILED DESCRIPTION OF EXEMPLARY EMBODIMENTS

Figure 1:
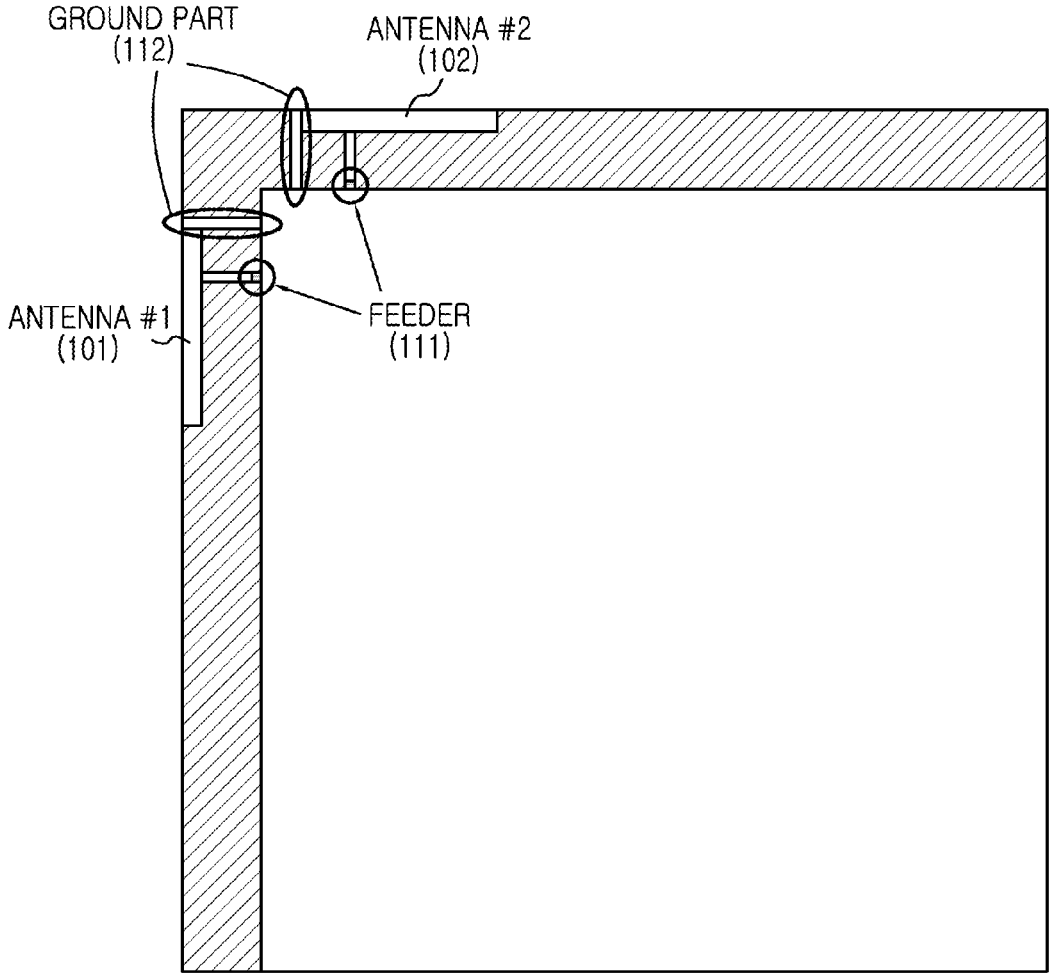
FIG. 1 (RELATED ART)
FIG. 1 illustrates a layout of antennas in a wireless communication system according to the related art.

The following description with reference to the accompanying drawings is provided to assist in a comprehensive understanding of exemplary embodiments of the invention as defined by the claims and their equivalents. It includes various specific details to assist in that understanding but these are to be regarded as merely exemplary. Accordingly, those of ordinary skill in the art will recognize that various changes and modifications of the embodiments described herein can be made without departing from the scope and spirit of the invention. In addition, descriptions of well-known functions and constructions may be omitted for clarity and conciseness.

The terms and words used in the following description and claims are not limited to the bibliographical meanings, but are merely used by the inventor to enable a clear and consistent understanding of the invention. Accordingly, it should be apparent to those skilled in the art that the following description of exemplary embodiments of the present invention are provided for purposes of illustration only and not for the purpose of limiting the invention as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

By the term "substantially" it is meant that the recited characteristic, parameter, or value need not be achieved exactly, but that deviations or variations, including for example, tolerances, measurement error, measurement accuracy limitations and other factors known to skill in the art, may occur in amounts that do not preclude the effect the characteristic was intended to provide.

Exemplary embodiments of the present invention provide a technique for obtaining a low coupling coefficient in a wide frequency bandwidth by minimizing interference between antennas, which are close to each other, without an additional device, in a wireless communication system.

FIGS. 3 through 11, discussed below, and the various exemplary embodiments used to describe the principles of the present disclosure in this patent document are by way of illustration only and should not be construed in any way that would limit the scope of the disclosure. Those skilled in the art will understand that the principles of the present disclosure may be implemented in any suitably arranged communications system. The terms used to describe various embodiments are exemplary. It should be understood that these are provided to merely aid the understanding of the description, and that their use and definitions in no way limit the scope of the invention. Terms first, second, and the like are used to differentiate between objects having the same terminology and are in no way intended to represent a chronological order, unless where explicitly state otherwise. A set is defined as a non-empty set including at least one element.

Figure 3:
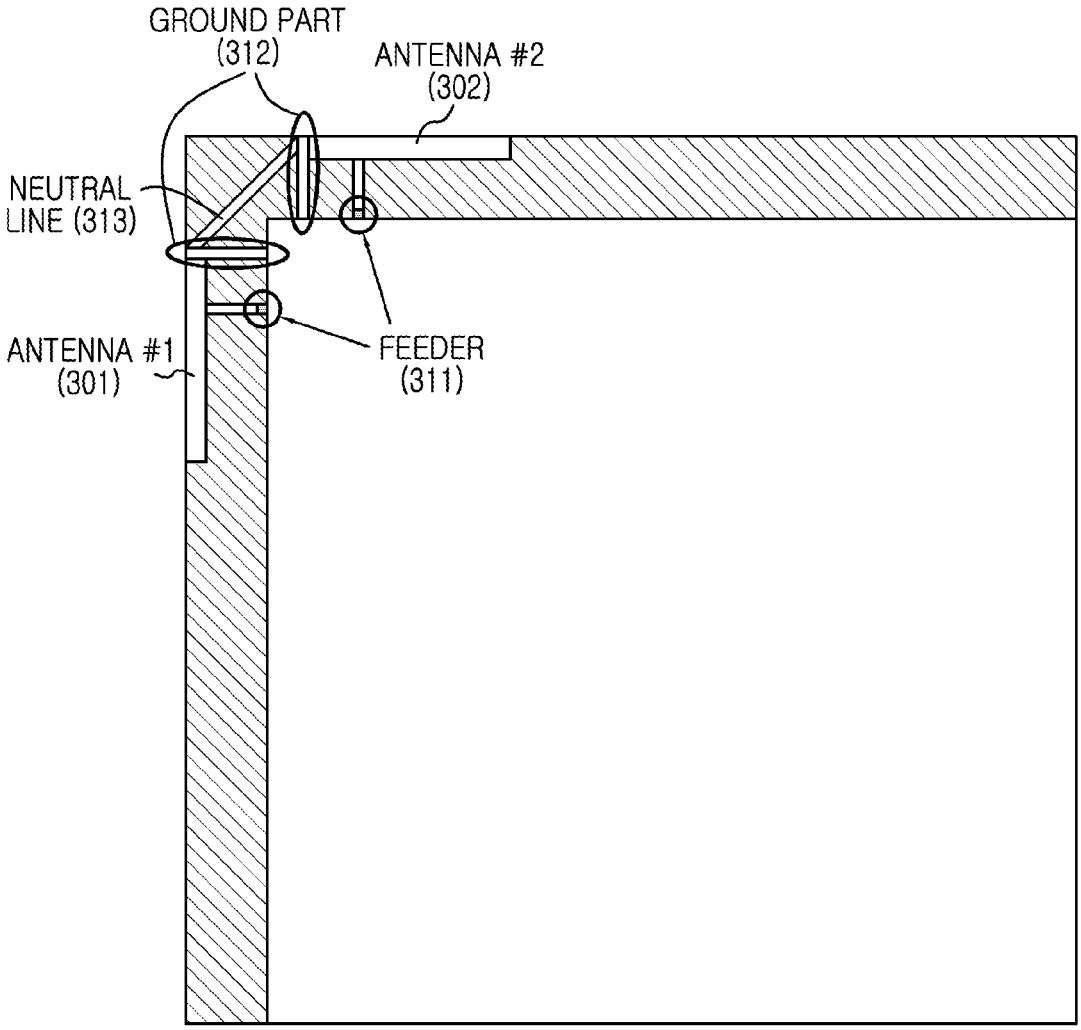
FIG. 3 illustrates an antenna design according to an exemplary embodiment of the present invention.

FIG. 3 illustrates an antenna design according to an exemplary embodiment of the present invention.

Referring to FIG. 3, an antenna #1 301 and an antenna #2 302 are located at perpendicular sides around the same corner of a board. More particularly, the antenna #1 301 and the antenna #2 302 are placed at a certain angle based on a neutral line 313 at the corner of the board. The certain angle can be an angle of two sides forming the corner. The antenna #1 301 and the antenna #2 302 are fed with signals via feeders 311, and connected to the ground through ground parts 312. To reduce the coupling coefficient between the antenna #1 301 and the antenna #2 302, the neutral line 313 is interposed between the antenna #1 301 and the antenna #2 302. The neutral line 313 directly interconnects the antenna #1 301 and the antenna #2 302. Characteristics according to the antenna design of FIG. 3 are shown in FIG. 4.

Figure 4:
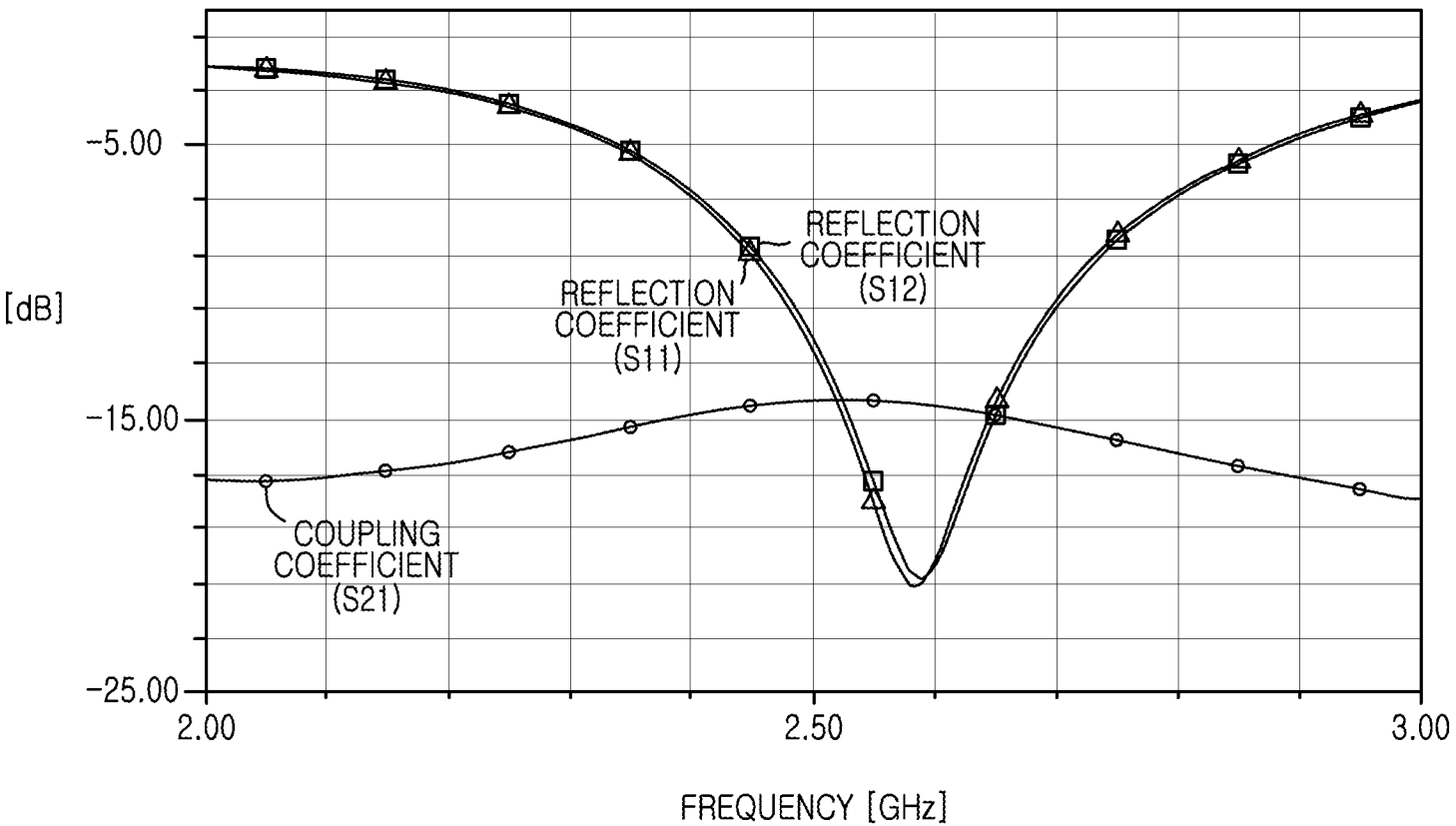
FIG. 4 illustrates characteristics of an antenna design according to an exemplary embodiment of the present invention.

FIG. 4 illustrates characteristics of an antenna design according to an exemplary embodiment of the present invention.

Figure 2:
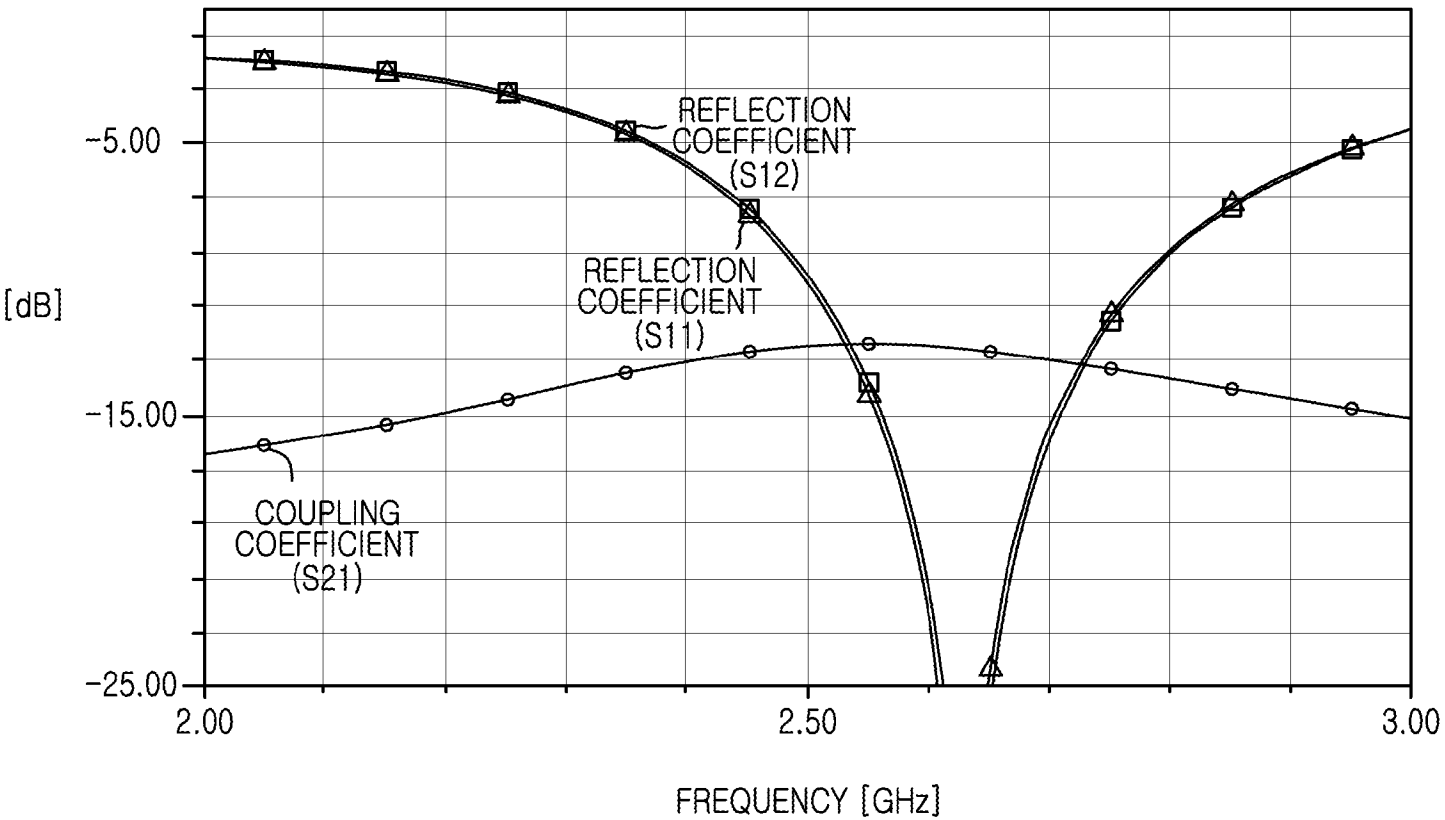
FIG.2 (RELATED ART)
FIG. 2 illustrates characteristics of antennas in a wireless communication system according to the related art.

Referring to FIG. 4, a horizontal axis indicates a frequency band, and a vertical axis indicates a magnitude of a reflection coefficient and a coupling coefficient. Reflection coefficient (S12) is a parameter indicating the degree of antenna transmission power that is reflected, rather than emitted. Lower reflection coefficient (S11) signifies a better antenna radiation performance. Coupling coefficient (S21) is a parameter indicating the degree of the signal emitted from one antenna and input to another antenna. The lower coupling coefficient signifies a lower interference between the antennas. In the band from 2.5 GHz to 2.7 GHz in FIG. 4, the coupling coefficient decreases, compared to the simple antenna arrangement of FIG. 1, which is illustrated in FIG. 2.

Figure 5:
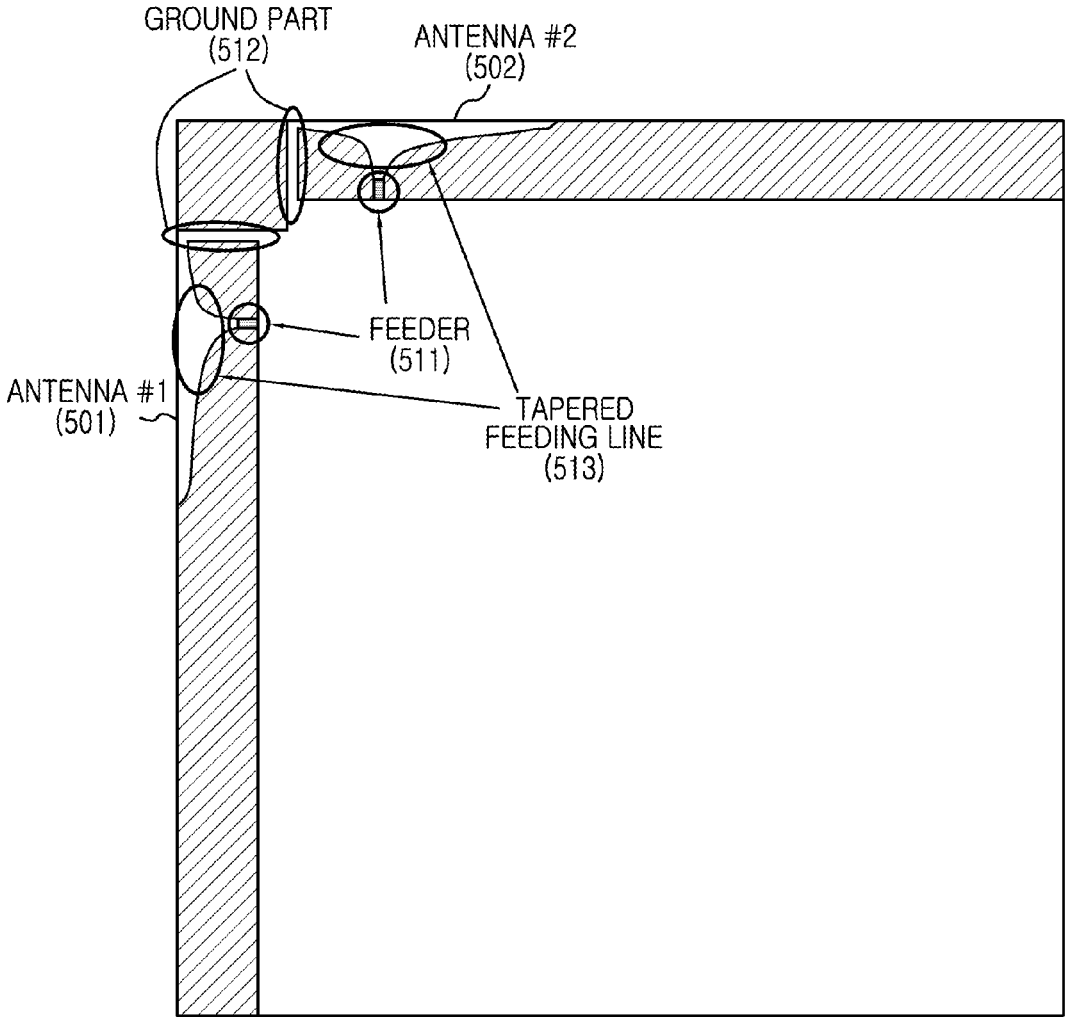
FIG. 5 illustrates an antenna design according to an exemplary embodiment of the present invention.

FIG. 5 illustrates an antenna design according to an exemplary embodiment of the present invention.

Referring to FIG. 5, an antenna #1 501 and an antenna #2 502 are located at perpendicular sides around the same corner of a board. More particularly, the antenna #1 501 and the antenna #2 502 are placed at a certain angle at the corner of the board. The certain angle can be an angle of two sides forming the corner. The antenna #1 501 and the antenna #2 502 are fed with signals via feeders 511, and connected to the ground through ground parts 512. To extend the band of the low reflection coefficient of the antenna #1 501 and the antenna #2 502, connection lines between the antennas 501 and 502 and the feeders 511 are designed to gradually widen toward the antennas 501 and 502; that is, to gradually widen in the radiation direction of the signal. More specifically, the connection line is implemented using a tapered feeding line 513. Characteristics according to the antenna design of FIG. 5 are shown in FIG. 6.

Figure 6:
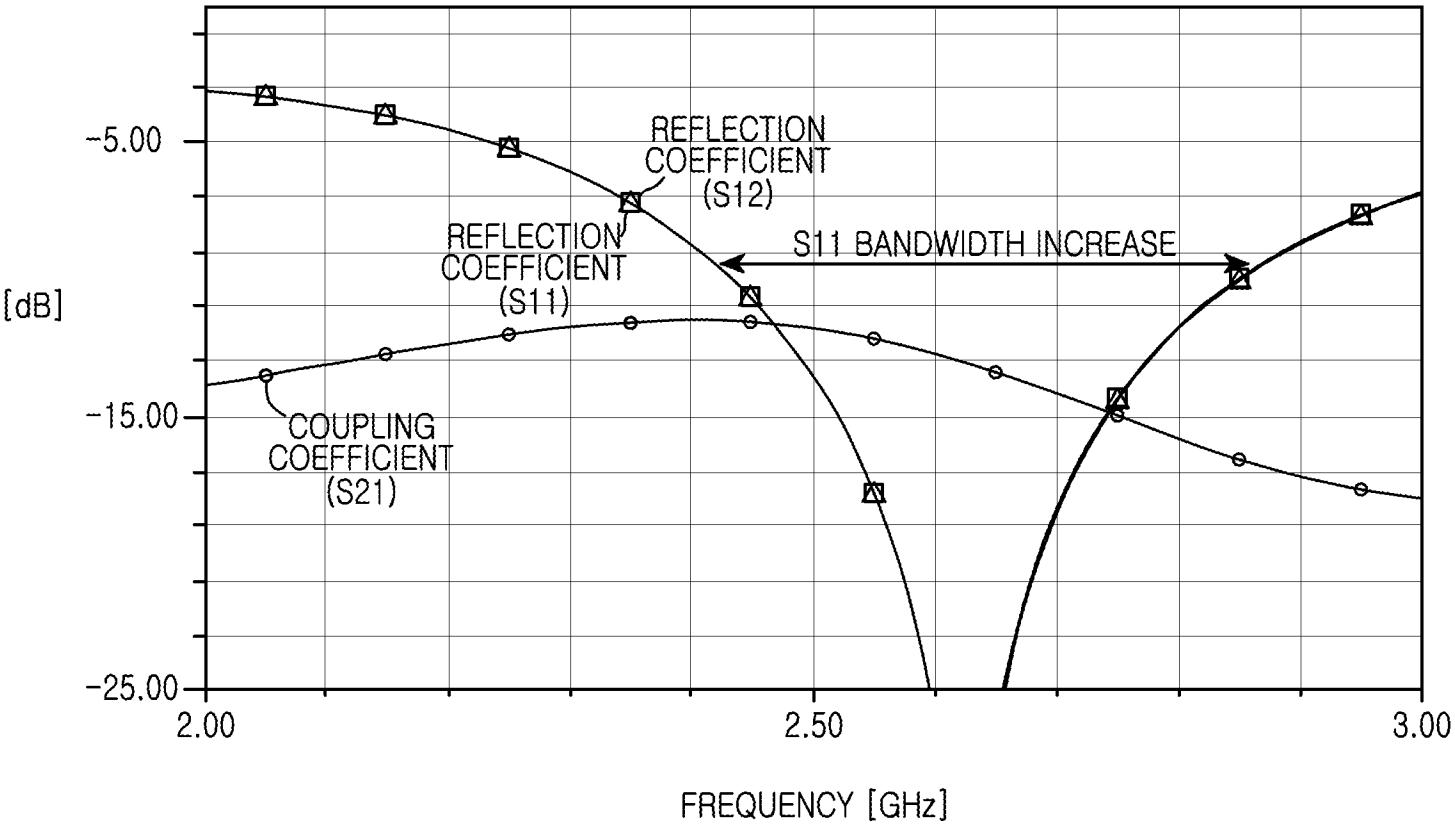
FIG. 6 illustrates characteristics of an antenna design according to an exemplary embodiment of the present invention.

FIG. 6 illustrates characteristics of an antenna design according to another exemplary embodiment of the present invention.

Referring to FIG. 6, a horizontal axis indicates a frequency band, and a vertical axis indicates a magnitude of a reflection coefficient and a coupling coefficient. Reflection coefficient (S12) is the parameter indicating the degree of antenna transmission power that is reflected, rather than emitted. Lower reflection coefficient (S11) signifies the better antenna radiation performance. Coupling coefficient (S21) is the parameter indicating the degree of the signal emitted from one antenna and input to another antenna. The lower coupling coefficient signifies the lower interference between the antennas. Compared to the simple antenna arrangement of FIG. 1, the bandwidth with the reflection coefficient below about −10 dB is extended.

Figure 7:
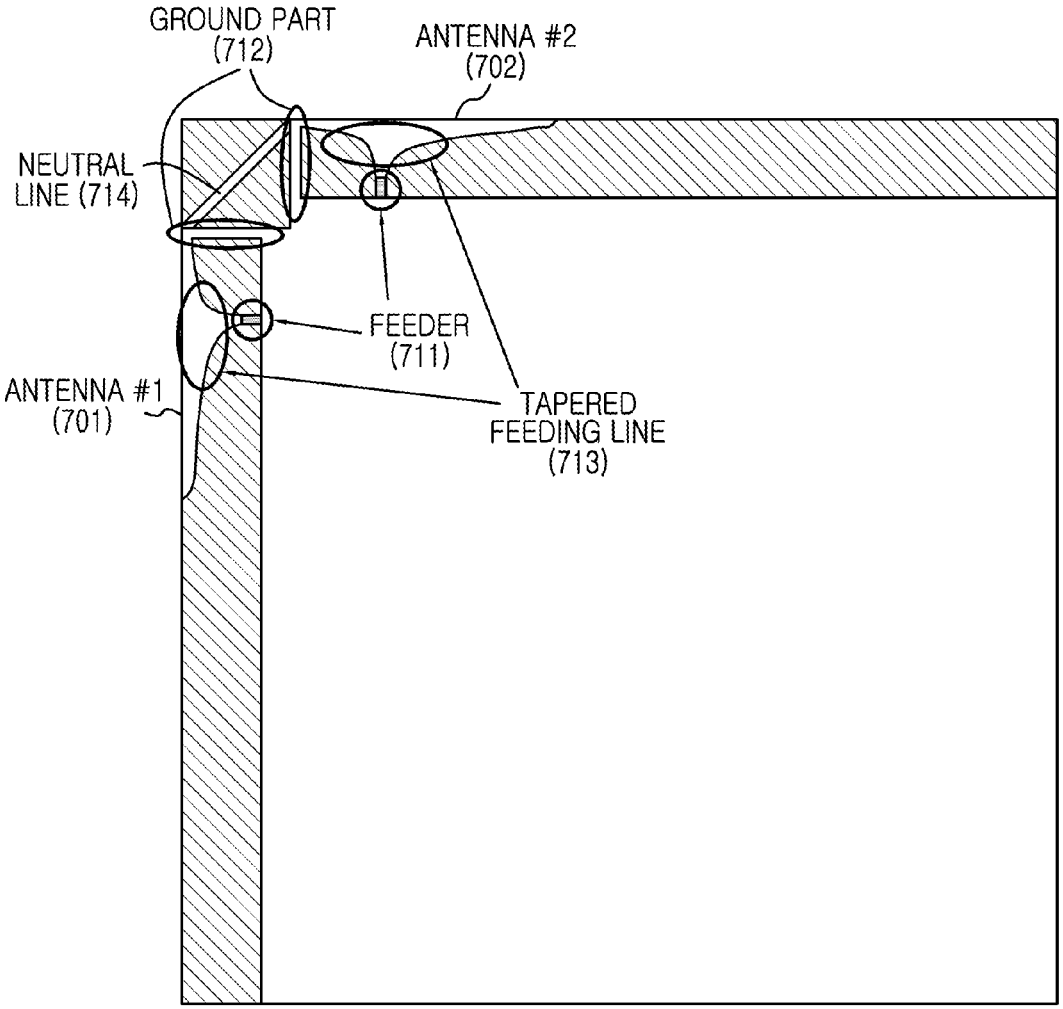
FIG. 7 illustrates an antenna design according to an exemplary embodiment of the present invention.

FIG. 7 illustrates an antenna design according to an exemplary embodiment of the present invention.

Referring to FIG. 7, an antenna #1 701 and an antenna #2 702 are located at perpendicular sides around the same corner of a board. More particularly, the antenna #1 701 and the antenna #2 702 are placed at a certain angle based on a neutral line 714 at the corner of the board. The certain angle can be an angle of two sides forming the corner. The antenna #1 701 and the antenna #2 702 are fed with signals via feeders 711, and connected to the ground through ground parts 712. To extend the band of the low reflection coefficient of the antenna #1 701 and the antenna #2 702, connection lines between the antennas 701 and 702 and the feeders 711 are designed to gradually widen toward the antennas 701 and 702; that is, to gradually widen in the radiation direction of the signal. More specifically, the connection line is implemented using a tapered feeding line 713. To decrease the coupling coefficient between the antenna #1 701 and the antenna #2 702, the neutral line 714 is located between the antenna #1 701 and the antenna #2 702. The neural line 714 directly interconnects the antenna #1 701 and the antenna #2 702. Characteristics according to the antenna design of FIG. 7 are shown in FIG. 8.

Figure 8:
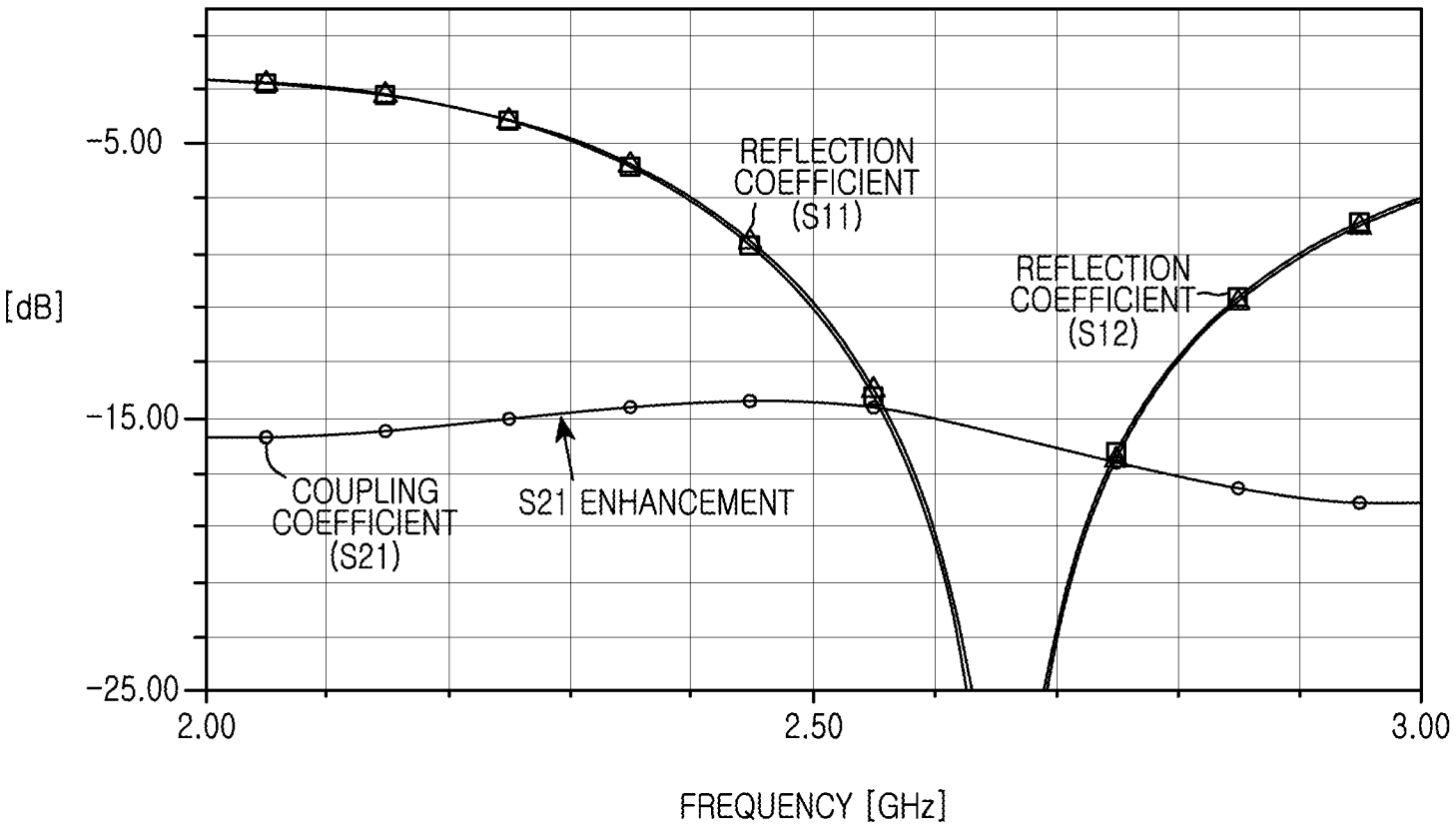
FIG. 8 illustrates characteristics of an antenna design according to an exemplary embodiment of the present invention.

FIG. 8 illustrates characteristics of an antenna design according to an exemplary embodiment of the present invention.

Referring to FIG. 8, a horizontal axis indicates a frequency band, and a vertical axis indicates a magnitude of a reflection coefficient and a coupling coefficient. Reflection coefficient (S11) is the parameter indicating the degree of antenna transmission power that is reflected, rather than emitted. Lower reflection coefficient (S12) signifies the better antenna radiation performance. Coupling coefficient (S21 Enhancement) is the parameter indicating the degree of the signal emitted from one antenna and input to another antenna. The lower coupling coefficient (S21) signifies the lower interference between the antennas. Compared to the simple antenna arrangement of FIG. 1, the bandwidth with the reflection coefficient below about −10 dB is extended. In the band from 2.5 GHz to 2.7 GHz in FIG. 8, the coupling coefficient decreases, compared to FIG. 1.

Figure 9:
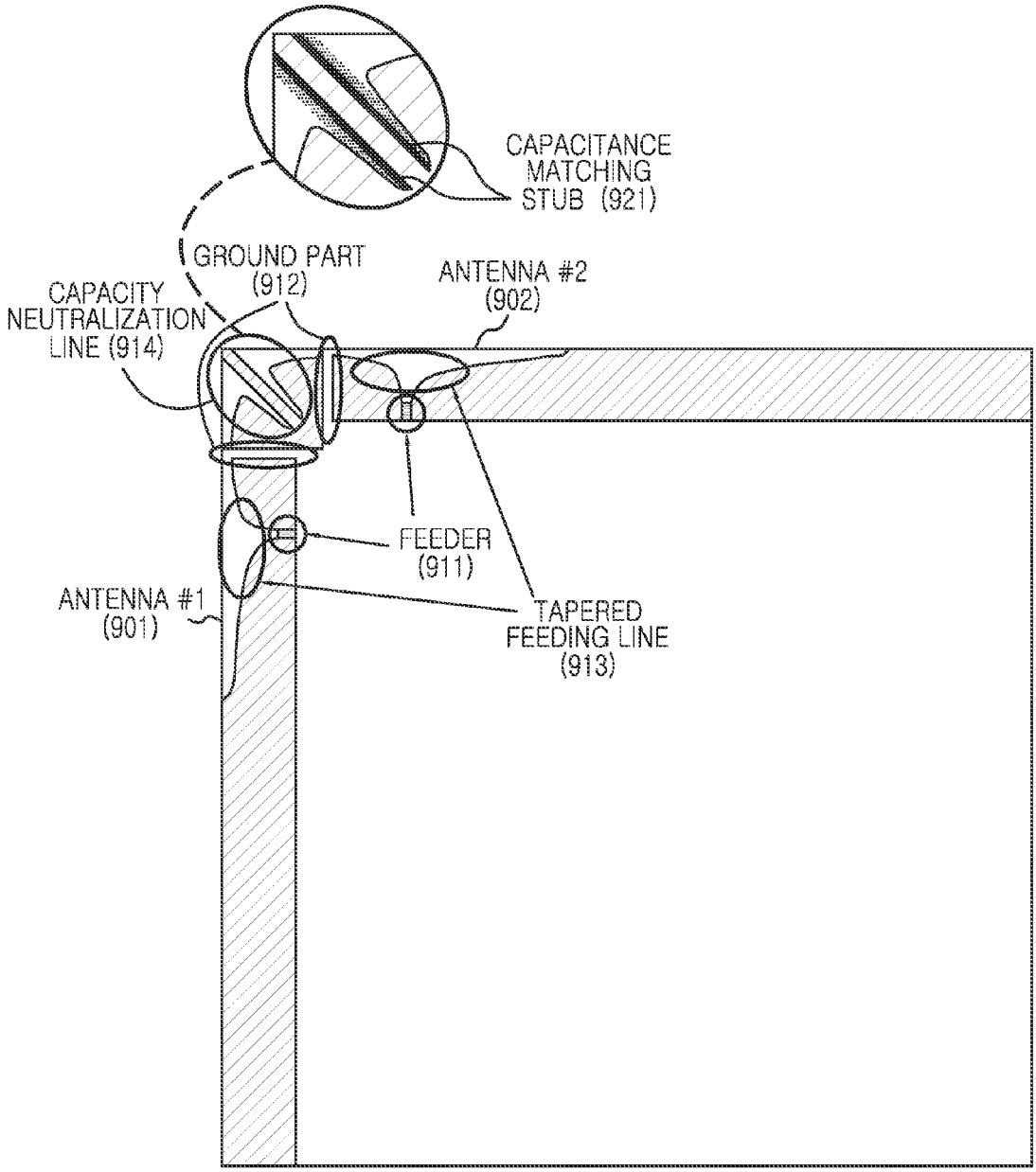
FIG. 9 illustrates an antenna design according to an exemplary embodiment of the present invention.

FIG. 9 illustrates an antenna design according to an exemplary embodiment of the present invention.

Referring to FIG. 9, an antenna #1 901 and an antenna #2 902 of FIG. 9 are located at perpendicular sides around the same corner of a board, and fed with signals via feeders 911, and connected to the ground through ground parts 912. More specifically, the antenna #1 901 and the antenna #2 902 are placed at a certain angle based on a capacitive neutralization line at the corner of the board. The certain angle can be an angle of two sides forming the corner. To extend the band of the low reflection coefficient of the antenna #1 901 and the antenna #2 902, connection lines between the antennas 901 and 902 and the feeders 911 are designed to gradually broaden toward the antennas 901 and 902; that is, to gradually broaden in the radiation direction of the signal. More specifically, the connection line is implemented using a tapered feeding line 913. To decrease the coupling coefficient between the antenna #1 901 and the antenna #2 902, the capacitive neutralization line 914 is located between the antenna #1 901 and the antenna #2 902. The capacitive neutralization line 914 indirectly interconnects the antennas 901 and 902 using lines physically spaced apart. That is, the capacitive neutralization line 914 indirectly connects the antennas 901 and 902 using the physically disconnected line as shown in FIG. 9, and includes a capacitance matching stub at the separated part to compensate for mismatch of the capacitance. The length of a parallel conductor facing the capacitance matching stub is adjusted according to the capacitance value determined by the characteristics of the antenna. Characteristics according to the antenna design of FIG. 9 are shown in FIG. 10.

Figure 10:
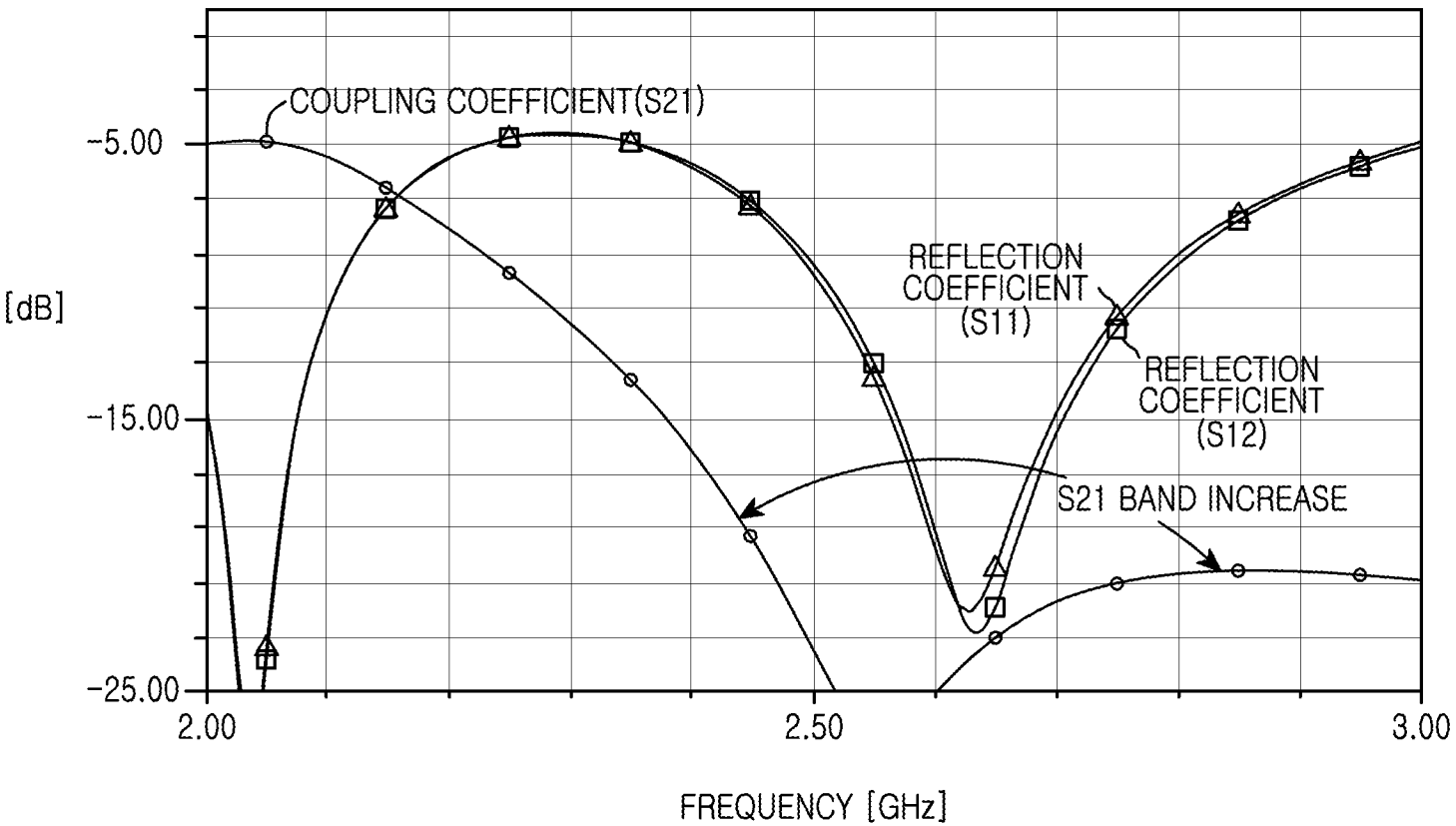
FIG. 10 illustrates characteristics of an antenna design according to an exemplary embodiment of the present invention.

FIG. 10 illustrates characteristics of an antenna design according to an exemplary embodiment of the present invention.

Referring to FIG. 10, a horizontal axis indicates a frequency band, and a vertical axis indicates a magnitude of a reflection coefficient and a coupling coefficient. Reflection coefficient (S11) is the parameter indicating the degree of antenna transmission power that is reflected, rather than emitted. Lower reflection coefficient (S12) signifies the better antenna radiation performance. Coupling coefficient (S21) is the parameter indicating the degree of the signal emitted from one antenna and input to another antenna. The lower coupling coefficient (S21 Band Increase) signifies the lower interference between the antennas. Compared to the simple antenna arrangement of FIG. 1, the bandwidth with the reflection coefficient below about −10 dB is extended. In the band from 2.5 GHz to 2.7 GHz in FIG. 10, the coupling coefficient remarkably decreases, compared to FIG. 1 and the other exemplary embodiments of the present invention.

Figure 11:
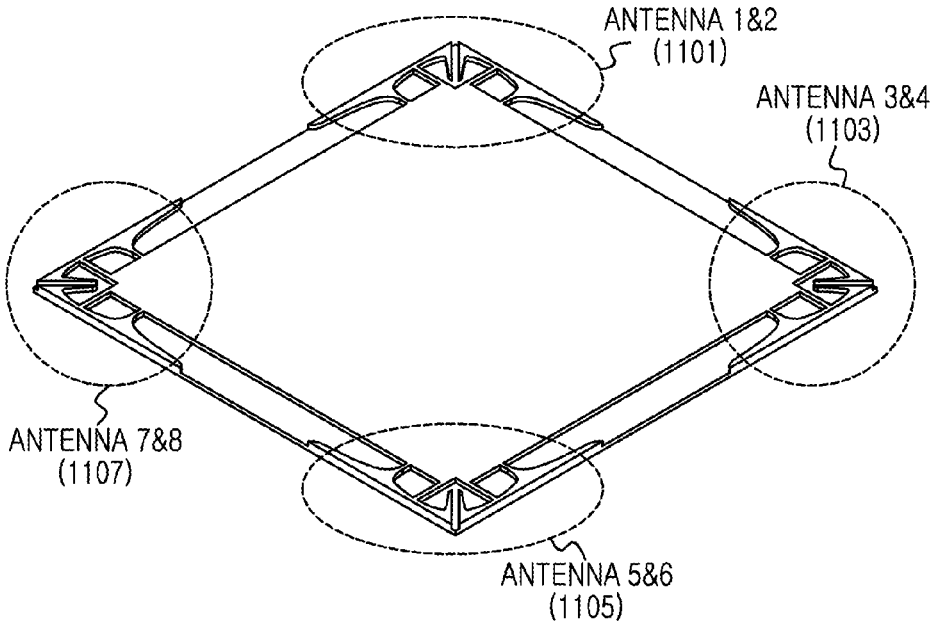
FIG. 11 illustrates an application of an antenna design according to an exemplary embodiment of the present invention.

FIG. 11 illustrates an application of an antenna design according to an exemplary embodiment of the present invention.

Referring to FIG. 11, a transceiver using a quadrangular board can include two antennas in each corner, that is, eight antennas 1101, 1103, 1105 and 1107 in total. The structure of FIG. 11 is applicable to a transceiver for wireless communication based on multiple antennas. For example, the structure of FIG. 11 can be applied to a user terminal or a compact base station.

By virtue of the design interconnecting antennas using a capacitive neutralization line, it is possible to effectively lower the coupling coefficient between the antennas and to obtain a low coupling coefficient in a wide frequency band. By virtue of the design of gradually broadening the feeder of each antenna, a low reflection coefficient is obtained for a wide frequency bandwidth. The two designs can achieve both of the low coupling coefficient and the low reflection coefficient between the antennas in a wide frequency band. Accordingly, since a separate device or a large separation distance is unnecessary to minimize the coupling between the adjacent antennas, it is very easy to design and install a Multiple Input Multiple Output (MIMO) antenna system requiring a plurality of antenna devices in a small space, such as a small terminal.

While the invention has been shown and described with reference to certain exemplary embodiments thereof, it will be understood by those skilled in the art that various changes in form and details may be made therein without departing from the spirit and scope of the invention as defined appended claims and their equivalents.

What is claimed is:

1. An apparatus having a plurality of antennas in a wireless communication system, the apparatus comprising:

a first antenna and a second antenna for transmitting and receiving signals over a radio channel; and a line, consisting of two conductors physically spaced apart, for decreasing a coupling coefficient by indirectly connecting the first antenna and the second antenna, wherein the first antenna and the second antenna are aligned at a right angle at a corner of a board, wherein the line is placed at the corner of the board, wherein an end of each of the two conductors is coupled to the first antenna and the second antenna respectively, and wherein the other ends of the two conductors face each other and comprise a capacitance matching stub to compensate for a mismatch of capacitance.

2. The apparatus of claim 1 wherein a length of the capacitance matching stub is determined by a capacitance value determined by characteristics of the antenna.

3. The apparatus of claim 1, further comprising:

a feeder for feeding a signal into the first antenna; and a tapered feeding line for interconnecting the first antenna and the feeder and designed to gradually widen in a radiation direction of the signal.

4. The apparatus of claim 1, further comprising:

a ground part for connecting the first antenna to the ground.

5. The apparatus of claim 1, wherein the first antenna and the second antenna have an inverted-F antenna structure.

6. The apparatus of claim 1, wherein the certain angle is an angle of two sides forming the corner of the board.

7. The apparatus of claim 1, further comprising:

a third antenna and a fourth antenna located in a corner other than the corner of the first antenna and the second antenna.

8. The apparatus of claim 1, wherein the line is a capacitive neutralization line interposed between the first antenna and the second antenna.

* * * * *